US012332015B1

(12) United States Patent
Reis

(10) Patent No.: US 12,332,015 B1
(45) Date of Patent: Jun. 17, 2025

(54) FIREARM STOCK WITH HYDRAULIC DAMPENING

(71) Applicant: Harlei Fernandes Reis, Mineiros (BR)

(72) Inventor: Harlei Fernandes Reis, Mineiros (BR)

( * ) Notice: Subject to any disclaimer, the term of this patent is extended or adjusted under 35 U.S.C. 154(b) by 0 days.

(21) Appl. No.: 18/427,990

(22) Filed: Jan. 31, 2024

(51) Int. Cl.
*F41C 23/06* (2006.01)

(52) U.S. Cl.
CPC ..... *F41C 23/06* (2013.01)

(58) Field of Classification Search
CPC ..... F41C 23/06; F41C 23/20; F41C 23/14
See application file for complete search history.

(56) References Cited

U.S. PATENT DOCUMENTS 476,246 A * 6/1892 Burgess ..... F41A 9/18 42/74
1,468,354 A * 9/1923 Caretto ..... F41C 23/14 42/74
1,480,350 A * 1/1924 Martin ..... F41C 23/14 42/74
3,039,222 A * 6/1962 Hoge ..... F41C 23/06 42/74
3,461,589 A * 8/1969 Vironda ..... F41C 23/06 42/1.06
3,707,797 A * 1/1973 Ruth ..... F41C 23/06 42/74
4,663,877 A * 5/1987 Bragg ..... F41C 23/06 42/74
6,481,142 B1 * 11/2002 McCarthy ..... F41C 23/06 42/74
7,162,822 B1 * 1/2007 Heayn ..... F41C 23/04 42/71.01
11,953,289 B2 * 4/2024 Angers, Jr. ..... F41C 23/14
12,181,245 B1 * 12/2024 Chiang ..... F41C 23/20
2002/0053156 A1 * 5/2002 Mccarthy ..... F41C 23/06 42/74
2008/0178508 A1 * 7/2008 Cinciu ..... F41C 23/06 42/1.06
2010/0122482 A1 * 5/2010 Simms ..... F41C 23/14 42/1.06
2011/0138668 A1 * 6/2011 Thomas ..... F41C 23/06 42/1.06
2013/0000175 A1 * 1/2013 Quaedpeerds ..... F41C 23/20 42/73

(Continued)

*Primary Examiner* — Joshua E Freeman
(74) *Attorney, Agent, or Firm* — Bay State IP, LLC

(57) ABSTRACT

The disclosure relates to the firearms and accessories manufacturing sector, and more specifically to a stock with a hydraulic damping system and anatomical regulation that supports and controls the shooter, allowing them to hold the weapon stably while aiming and firing accurately. This invention discloses a stock with a hydraulic damping system that aims to significantly reduce the impact of firing on firearms. The stock uses an internal hydraulic mechanism that absorbs and disperses some of the energy generated by the impact, providing a smoother and more comfortable shooting experience for the shooter. The hydraulic damping system consists of a piston, oil chamber and valve assembly designed to work together. When the gun is fired, the impact causes the piston to move inside the oil chamber, compressing the hydraulic fluid. This movement creates a controlled resistance, which helps cushion the impact and dissipate the energy of the gun shot.

1 Claim, 3 Drawing Sheets

(56) References Cited

U.S. PATENT DOCUMENTS

| | | | | |
|---|---|---|---|---|
| 2014/0250756 | A1* | 9/2014 | Vesligaj | F41C 23/06<br>42/74 |
| 2016/0273873 | A1* | 9/2016 | Spyche, Jr. | F16F 9/18 |
| 2017/0321989 | A1* | 11/2017 | Kronsteiner | F41C 23/06 |
| 2018/0073835 | A1* | 3/2018 | Saltzman | F41C 23/06 |
| 2020/0149840 | A1* | 5/2020 | Schoenborn | F41C 23/14 |
| 2023/0077334 | A1* | 3/2023 | Hannah | F41C 23/20<br>42/71.01 |
| 2023/0168063 | A1* | 6/2023 | Angers, Jr. | F41C 23/04<br>42/73 |
| 2024/0255251 | A1* | 8/2024 | Angers, Jr. | F41C 23/14 |

* cited by examiner

FIREARM STOCK WITH HYDRAULIC DAMPENING

BACKGROUND OF THE INVENTION

Field of the Invention

This invention belongs to the firearms and accessories manufacturing sector. It relates more specifically to a stock with a hydraulic damping system and anatomical regulation that supports and controls the shooter, allowing them to hold the weapon stably while aiming and firing accurately.

Description of the Related Art

Stock damping is an important feature in firearms, especially those used in activities such as sport shooting, hunting, or military and police operations. The stock is the rear of the gun, where the shooter positions the shoulder to stabilize it during firing. Stock damping refers to the measures taken to reduce the impact felt by the shooter when firing the weapon.

The impact is the force that pushes the gun back after firing, caused by the release of pressure generated by burning the propellant inside the cartridge. The impact is the "kick" sensation the shooter feels on their shoulder due to the impact.

There are various techniques and technologies used to improve stock damping. Some of these include:

Stock Design: The stock is designed to provide a proper fit to the shooters shoulder and distribute the impact evenly. Materials such as polymers, rubbers and pads can be incorporated into the stock to provide greater comfort and shock absorption;

Shock absorbing materials: Some manufacturers use internal materials or add coatings on the stock that have shock absorbing properties, reducing the impact felt by the shooter;

Muzzle brake and compensators: These devices are installed at the end of the barrel of the gun and are designed to redirect part of the gases from the shot upwards or to the sides. This helps to counterbalance the impact of the weapon and reduce the barrel lift, improving the stability of the shooter:

Recoil Reduction Systems: Some weapons have internal or external systems that help decrease recoil. This may include systems that absorb and dissipate some of the recoil energy before it reaches the shooter;

Choice of caliber and cartridge load: The caliber of the gun and the cartridge load directly influence the generated recoil. In some cases, choosing a smaller caliber or a less powerful charge can help reduce the impact felt by the shooter.

The problem of not having stock damping can negatively affect the shooter's experience when firing a firearm, especially at more powerful or more recoiled weapons. The stock damping is important in reducing the impact and discomfort caused by the shot's recoil. When a weapon does not have an adequate damping system, some problems may arise, such as: Nonconformity and fatigue, compromised accuracy, Difficulty in tracking the target, Injuries, Reduction of weapon control and Increased recovery time between shots. Therefore, there is a need for a stock with effective cushioning and accessible to shooters.

SUMMARY OF THE INVENTION

In this context, this invention discloses a stock with a hydraulic damping system that aims to reduce the impact of firing on firearms significantly. The stock uses an internal hydraulic mechanism that absorbs and disperses some of the energy generated by the impact, providing a smoother and more comfortable shooting experience for the shooter.

The hydraulic damping system consists of a piston, oil chamber and valve assembly designed to work together. When the gun is fired, the impact causes the piston to move inside the oil chamber, compressing the hydraulic fluid. This movement creates a controlled resistance, which helps cushion the impact and dissipate the energy of the gunshot.

The main advantages of a stock with a hydraulic damping system include:

- Impact reduction: The hydraulic system absorbs part of the impact generated by the shot, reducing the force that pushes the weapon back and minimizing the discomfort felt by the shooter;
- Barrel lift control: The damping helps to control the barrel lift after firing, facilitating faster and more accurate subsequent shots;
- Less shooter fatigue: With less impact on the shoulder, the shooter can shoot repeatedly without experiencing as much physical fatigue;
- Improved accuracy: By reducing the movement caused by the impact, the hydraulic stock can improve the overall accuracy of the shot.

Stocks with hydraulic damping systems can be used in sniper rifles, sport rifles and hunting rifles, where accuracy and comfort during successive shots are especially important.

BRIEF DESCRIPTION OF THE DRAWINGS

For this invention to be fully understood and put into practice by any technician in this technological sector, it will be described in a clear, concise and sufficient manner based on the attached drawings, which illustrate and subsidize it listed below.

DETAILED DESCRIPTION OF THE SEVERAL EMBODIMENTS

Figure 1:
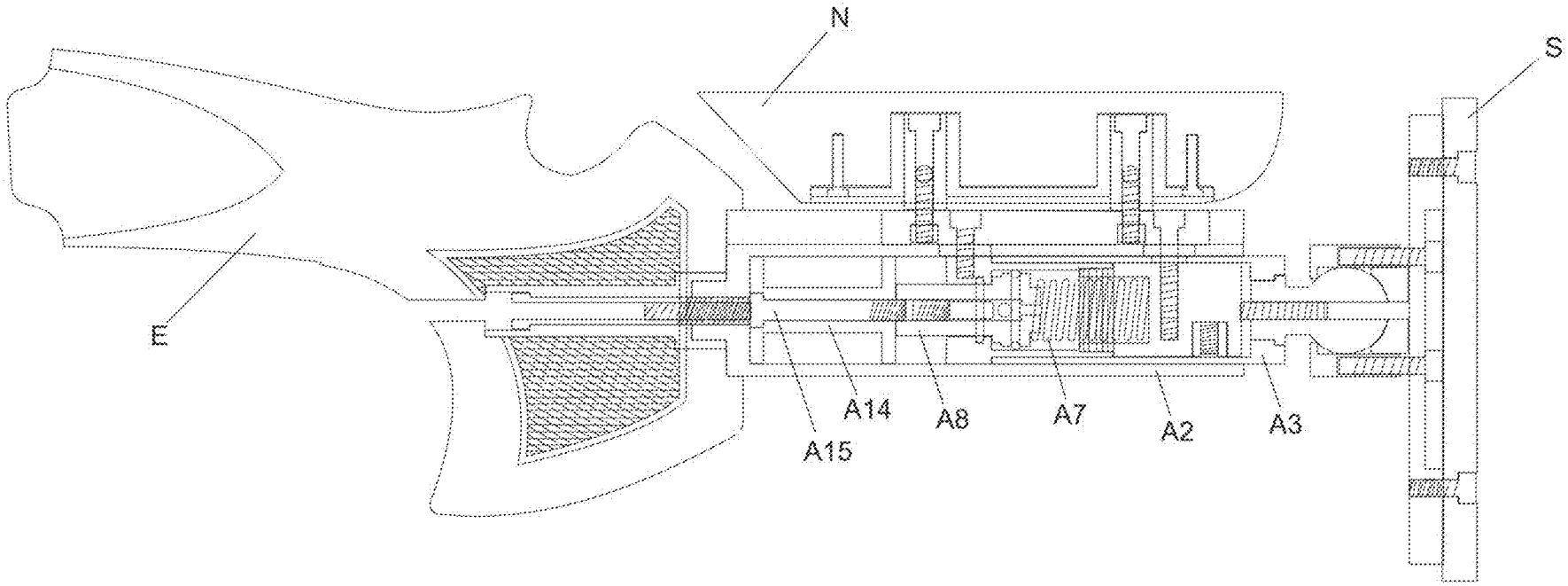
FIG. 1 depicts the side sectional view of the stock.
Figure 2:
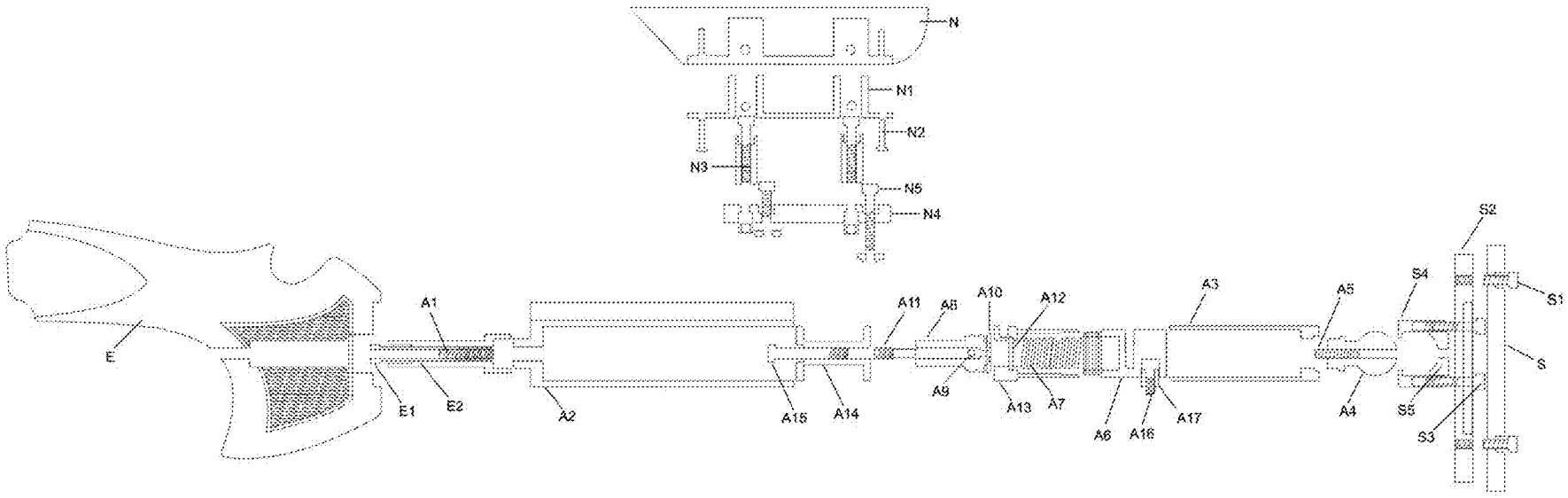
FIG. 2 depicts the exploded and sectional side view of the stock.
Figure 3:
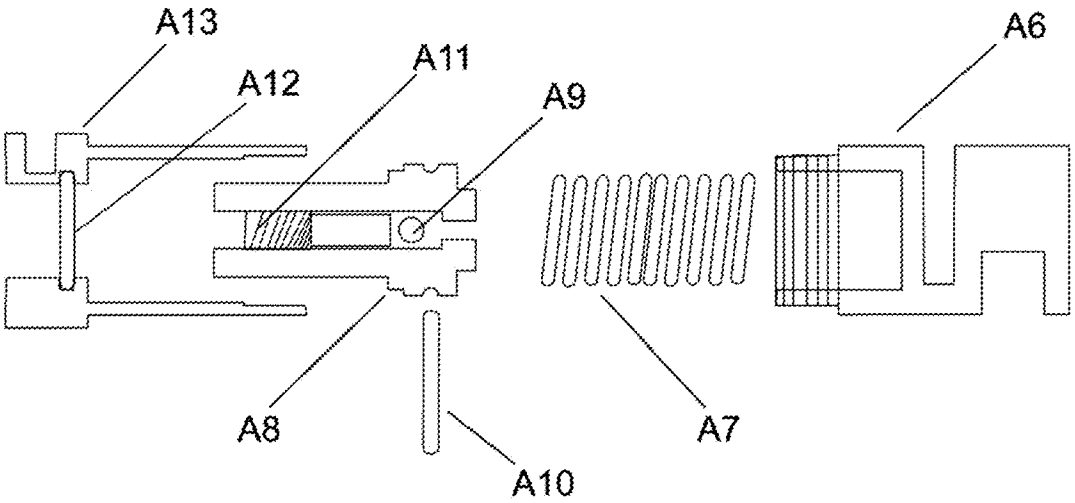
FIG. 3 depicts the exploded and sectional side view of the hydraulic damper.

The invention is formed by a stock that has an adjuster, also called stock adjuster (N), in wood, which receives an aluminum base (N1) through screws (N2), and the base has screws for height adjustment (N3) that are attached to a support (N4), which has screws of different lengths (N5); a wooden handle (E) and rubber threshold(S) which is joined by screws (S1) to an aluminum base (S2) which is joined by screws (S3) to an aluminum ball base (S4) equipped with clamping cradle (S5); and the handle (E) is integrated through a fixing screw (E1) and a bushing (E2) to the damper adjustment screw (A1) which is incorporated into the aluminum chassis tube (A2) which internally receives the length adjustment tube (A3) which is integrated into the sill(S) through the adjustment ball (A4) equipped with a length adjustment screw (A5) which is attached to the base (S4) and to the clamping cradle (S5), and which internally receives an aluminum shock absorber sealing nut (A6) that has a spiral spring (A7) in contact with the piston (A8) that has a flow control valve (A9), surrounded by a fluid scraping ring (A10) and a flow adjustment screw (A11) being arranged in the sealing retainer (A12) of the aluminum damper cylinder (A13), which is connected to a damper support (A14) through a set screw (A15); the tube (A13) is fixed to the stock adjuster (N) through the screw (N3), and the nut (A6) also receives a screw (N3) for fixing the stock adjuster and a screw (A16) and the fixation latch (A17) for fixing the tube (A3).

The rubber sill(S) is in contact with the shoulder, and the stock adjuster (N) with the shooter's cheek. The function of the hydraulic shock absorber is to dampen the impact of the shot from the spring (A7) that will absorb the impact backward, avoiding the reaction of the shot that would take the butt forward, hitting the shooter's face. Thus, the spring (A7) absorbs the shot impact and the internal fluid of the piston (A8) holds the return, releasing the inertia slowly.

It is important to note that the drawings and descriptions made do not have the power to limit the forms of execution of the inventive concept proposed herein but rather to illustrate and make understandable the conceptual innovations disclosed in this solution. Thus, the descriptions and images must be interpreted in an illustrative and non-limiting manner, and there may be other equivalent or analogous forms of implementation of the inventive concept disclosed herein that do not deviate from the protection spectrum outlined in the proposed solution.

What is claimed is:

1. A firearm stock with hydraulic damping comprising a wooden stock adjuster (N) that receives an aluminum base (N1) through screws (N2), and the base has screws for height adjustment (N3) that are attached to a support (N4), which has screws of different lengths (N5); a wooden handle (E) and a rubber threshold(S) which is joined by screws (S1) to an aluminum base (S2) which is joined by screws (S3) to an aluminum ball base (S4) equipped with a clamping cradle (S5), and characterized in that the handle (E) is integrated through a fixing screw (E1) and a bushing (E2) to a damper adjustment screw (A1) which is incorporated into an aluminum chassis tube (A2) which internally receives a length adjustment tube (A3) which is integrated into the rubber threshold(S) through an adjustment ball (A4) equipped with a length adjustment screw (A5) which is attached to the aluminum ball base (S4) and to the clamping cradle (S5), and which internally receives an aluminum shock absorber sealing nut (A6) that has a spiral spring (A7) in contact with a piston (A8) that has a flow control valve (A9), surrounded by a fluid scraping ring (A10) and a flow adjustment screw (A11) being arranged in a sealing retainer (A12) of an aluminum damper cylinder (A13), which is connected to a damper support (A14) through a set screw (A15); the aluminum chassis tube (A2) is fixed to the stock adjuster (N) through the screw (N3), and the aluminum shock absorber sealing nut (A6) also receives a screw (N5) for fixing the stock adjuster; and a screw (A16) and fixation latch (A17) for fixing the length adjustment tube (A3).

* * * * *